US005405427A

United States Patent [19]

Eckert

[11] Patent Number: 5,405,427

[45] Date of Patent: Apr. 11, 1995

[54] SALT FLUX FOR ADDITION TO MOLTEN METAL ADAPTED FOR REMOVING CONSTITUENTS THEREFROM AND METHODS OF USING

[76] Inventor: C. Edward Eckert, 260 Lynn Ann Dr., New Kensington, Pa. 15068

[21] Appl. No.: 245,551

[22] Filed: May 18, 1994

[51] Int. Cl.[6] ..... C22B 21/00; C22B 21/06

[52] U.S. Cl. ..... 75/308; 75/672; 75/685

[58] Field of Search ..... 75/308, 672, 685

[56] References Cited

U.S. PATENT DOCUMENTS 1,718,917 6/1929 Bowers .
1,841,599 1/1932 Hardesty .
1,882,601 10/1932 Hollup .
1,975,084 10/1934 Davies .
2,262,105 5/1940 Jacobs .
2,479,798 8/1949 Wasserman .
2,499,827 3/1950 Kihlgren .
2,626,339 1/1953 Wasserman .
2,900,490 8/1959 Petryck et al. .
3,041,413 6/1962 Williams .
3,753,690 8/1973 Emley et al. ..... 75/680
4,030,914 6/1977 Papafingos et al. .
4,365,993 12/1982 Meredith et al. .
4,761,207 8/1988 Stewart, Jr. et al. .
4,983,216 1/1991 Van Linden et al. .

*Primary Examiner*—Melvyn J. Andrews
*Attorney, Agent, or Firm*—Andrew Alexander

[57] ABSTRACT

Disclosed is an improved flux comprising 32 to 61 wt. % sodium chloride, 2 to 15 wt. % magnesium chloride, 2 to 12 wt. % carbon, the remainder potassium chloride.

22 Claims, No Drawings

SALT FLUX FOR ADDITION TO MOLTEN METAL ADAPTED FOR REMOVING CONSTITUENTS THEREFROM AND METHODS OF USING

BACKGROUND OF THE INVENTION

This invention relates to salt fluxes and more particularly, this invention relates to a salt flux suitable for use in fluxing or purifying molten aluminum.

In the prior references, there is disclosed the use of salt fluxes that are added to molten metal such as molten aluminum to remove inclusions such as oxides from the melt in order to provide an improved metal having superior properties. For example, U.S. Pat. No. 1,841,599 discloses the use of BaO, $BaCO_3$, NaF, $KClO_3$ and carbon. The patent discloses that oxides and oxy-salts of barium are particularly effective in reacting with non-metallic impurities in non-ferrous metals such as aluminum. U.S. Pat. No. 3,041,413 discloses the use of carbides of the alkali metals and the carbides of alkaline earth metals, the carbides being dissolved in molten solvents. The patent discloses the use of a fluxing agent such as sodium and potassium halides to aid in the dissolution of the carbides.

U.S. Pat. No. 1,718,917 discloses a composition or flux suitable for welding, brazing or tempering compound, the compound suitable for use upon oily or greasy metallic surfaces without the necessity of cleaning. The flux has the following ingredients: borax, sol-ammerriac, Venetian red, bicarbonate of soda, salt and powdered coke. According to the patent, the coke is used as a reducing agent to prevent oxidation of the metals.

U.S. Pat. No. 1,882,601 discloses a flux for coating welding rods for welding stainless steels. The flux contains 60% calcium fluoride or carbonate, 20% sodium fluoride and 20% carbon, and the ingredients may be varied according to the following: 40 to 80% alkaline earth salt, 15 to 40% alkaline halide flux and 15 to 40% carbonaceous material.

U.S. Pat. No. 1,975,084 discloses a flux composition for use with non-ferrous metals such as aluminum. The flux composition contains equal parts of an alkali metal chlorate, manganese dioxide, a boron compound, calcium fluoride, zinc, manganese, hematite, dolomite and a carbonaceous substance.

U.S. Pat. No. 2,262,105 discloses a flux for use in melting light metals such as magnesium and aluminum. The flux composition has the following ranges: 20 to 50% magnesium chloride, 25 to 40% calcium chloride, up to 30% sodium chloride and potassium chloride and 0 to 5% magnesium oxide.

U.S. Pat. No. 2,479,798 discloses a welding flux for welding ferrous metals. The flux contains parts by weight, 30 to 50 parts sodium carbonate monohydrate, 10 to 30 parts alkali metal pentaborate, 20 to 40 parts alkali metal nitrate, 5 to 20 parts silica, 1 to 10 parts graphite, and 1 to 10 parts oxide of iron or manganese.

U.S. Pat. No. 2,499,827 discloses a welding electrode for cast iron having a flux coating containing 25–50 parts calcium carbonate, 20 to 35 parts calcium fluoride, 0 to 30 parts iron powder, 10 to 30 parts carbon, 1 to 10 parts ferro-25 titanium and 3 to 6 parts bentonite. A binder may be added to this composition.

U.S. Pat. No. 2,626,339 discloses a welding rod for welding copper alloys. The rod is coated with a flux composition composed of 5 to 15 wt. % carbonaceous material, 15 to 45 wt. % metal carbonate, 20 to 60 wt. % metal fluoride, and from 12.5 to 28 wt. % of a binder of sodium and/or potassium silicate.

U.S. Pat. No. 2,900,490 discloses a flux-coated electrode for welding cast iron. The flux is composed of (parts by weight) 25 to 40 parts alkaline earth metal carbonate, 15 to 30 parts alkaline earth metal fluoride, 15 to 30 parts carbon, 3 to 6 parts silicon as ferro-silicon and 2 to 10 parts rare earth metal and/or rare earth metal oxide.

U.S. Pat. No. 4,761,207 discloses a slat-based melting process for melting aluminum scrap. The salt contains chlorides and fluorides of sodium, potassium, magnesium, aluminum, calcium and lithium. According to the patent, carbon or carbon monoxide is used to control oxide concentration.

U.S. Pat. No. 4,983,216 discloses the use of halide salts such as alkaline earth metal halides or alkali metal halides such as Li, Na, K, Mg and Cu chloride or fluorides in melting aluminum scrap.

U.S. Pat. No. 4,030,914 discloses that aluminum drosses are treated under a cover flux of sodium chloride or potassium chloride or mixtures thereof in combination with calcium chloride, the calcium chloride comprising about 1 to 50% of the flux composition.

U.S. Pat. No. 4,365,993 discloses treating lacquer-coated aluminum scrap with a solution of a mixture of halide salts. The mixture is applied to the scrap before the lacquer coating is pyrolyzed, leaving a metal relatively free from oxide inclusions. The preferred flux is a 50:50 mixture of sodium chloride and potassium chloride, with an optional addition of up to 3% of an alkali metal fluoride.

However, in spite of these fluxes and processes, there is still a great need for an economic, low melting point flux that is free from the use of fluorides. It will be appreciated that fluorides are generally ecologically and hygienically unacceptable. It will be noted that certain fluxes are suggested that do not employ fluorides; however, often these types of fluxes are not as effective in separating molten aluminum from dross or in minimizing oxidation of aluminum scrap during or after the melting process. Consequently, such fluxes can result in increased oxidation and greater losses of molten aluminum to dross or skim, seriously affecting the economics of the scrap recovery process.

The subject flux has the advantage that it does not require or contain fluorides and thus is ecologically acceptable. In addition, the flux can be added in-line to sequestor oxides floating to the surface and to minimize skim.

SUMMARY OF THE INVENTION

It is an object of the present invention to provide an improved flux suitable for non-ferrous metals.

It is a further object of the present invention to provide an improved flux suitable for use with aluminum.

It is another object of the present invention to provide an improved flux salt free from the use of fluorides.

It is still another object of the present invention to provide an improved flux that is effective in reducing oxidation of aluminum scrap during melting.

Yet, it is still another object of the invention to add the flux in-line to improve effectiveness of continuous or batch metal treatment using rotary impeller device.

These and other objects will become apparent from a reading of the specification and claims appended hereto.

In accordance with these objects, there is provided an improved flux comprising 32 to 61 wt. % sodium chloride, 2 to 15 wt. % magnesium chloride, 2 to 12 wt. % carbon, the remainder potassium chloride. The ranges herein are inclusive of all the numbers within the range.

DETAILED DESCRIPTION OF THE PREFERRED EMBODIMENTS

In accordance with the invention, there is provided a flux composition comprised of sodium chloride, potassium chloride, magnesium chloride and carbon. The flux composition can contain 32 to 61 wt. % sodium chloride, 32 to 61 wt. % potassium chloride, 2 to 15 wt. % magnesium chloride, and 2 to 12 wt. % carbon. Preferably, the composition contains 43 to 50 wt. % sodium chloride, 4 to 7 wt. % magnesium chloride, 3 to 8 wt. % carbon, the remainder potassium chloride. Typically, the flux composition comprises 46 to 48 wt. % sodium chloride, 46 to 48 wt. % potassium chloride, 5 to 7 wt. % magnesium chloride, and 5 to 7 wt. % carbon. By "carbon" as referred to herein is meant to include all types of carbon such as graphite, carbon, coke and any other source of carbon that may be suitably incorporated into the melt or scrap which enables fluxing in accordance with the invention. When the source of carbon is graphite, carbon or coke, etc., for purposes of the present invention, it is important that the carbon be ground to a small particle size in order to mix homogeneously with the salts and to disperse thoroughly in the melt. Thus, in accordance with the invention, the carbon can have a particle size in the range of −3 to +24 preferably a particle size in the range of −16 to +20 mesh U.S. Sieve series. The carbon is important in the flux composition because it can operate to minimize oxidation of molten metal such as molten aluminum. Thus, in this sense, the carbon is important in that it is operational in minimizing dross or skim formation. The flux of the invention minimizes skim generation by minimizing skim fires on the top of the melt. This flux composition is superior to previous fluxes by enabling less expensive and high recoveries of aluminum without the level of dross and skim generation. Further, the present flux enables superior separation of aluminum from dross or skim. This permits higher recovery levels of metal without inclusions of materials such as oxides and nitrides.

Operating within the ranges provided for the flux provides a low temperature melting range. For example, the flux composition of the invention provides for a melting point of less than 1320° F. This permits efficient use of the flux at lower melt temperatures, thus minimizing the tendency of the melt, e.g., molten aluminum, to form oxides, nitrides, etc. Further, the flux composition can be adjusted to operate at the melting point of the aluminum alloy being treated, thus avoiding excessive temperatures. Thus, the flux composition of the invention is more economical too use. The flux composition is efficient in its ability to capture inclusions.

The flux composition of the invention can be used as a cover flux, thereby reducing the available surface subject to oxidation. The cover flux has the ability to maintain higher temperatures in the melt without oxide formation. Thus, the cover flux has application to any stationary furnace or stationary well which is difficult to heat. Because of its high penetration ability, the flux composition is particularly suitable in aiding the separation of molten aluminum occluded in skim. The flux composition may be used with any suitable mechanical device used to stir skim layers for the separation of aluminum from the skim layer and permit the aluminum contained therein to return to the melt.

The flux composition of the invention can be used in rotary furnaces for the melting of aluminum scrap, for example. When used in a rotary furnace, the flux composition is very efficient in maintaining low levels of dross to provide for high levels of aluminum recovery free of inclusions such as oxides and nitrides. Thus, it will be appreciated that these recoveries can be achieved without the use of fluoride salts such as cryolite which were commonly used.

The flux composition of the invention can be injected or ingested into molten metal bodies, e.g., aluminum, for purposes of fluxing said bodies to remove or capture inclusions and carry such inclusions to the surface of the bodies. That is, the flux composition can be added to the surface of a body of molten aluminum and ingested and distributed by an impeller rotating in the body. The impeller can create a vortex that pulls the flux composition into the body and distributes the composition throughout the body. After the body has been thoroughly contacted by flux composition, the impeller may be stopped to permit the flux composition to float to the molten aluminum surface. In floating to the surface, the flux composition carries with it captured inclusions. Further, the flux composition may be injected into the body of molten aluminum by any means that enables introduction of the flux composition to the melt. The flux composition can be injected in powder or in molten form. Thus, it will be appreciated that the subject flux composition is particularly suitable because of its ability in reducing melting point.

The flux composition of the invention has the advantage that it can be used along with gaseous fluxing media such as argon, helium, neon, krypton, xenon, along with nitrogen, carbon dioxide and mixtures of these gases along with mixtures of these gases and chlorinaceous gas such as chlorine. The gaseous media is particularly suitable in removing impurities such as entrapped gases, e.g., hydrogen, or oxide particles. The fluxing gas can be used in conjunction with the flux composition. That is, while the flux composition is being ingested by an impeller and distributed throughout the molten metal body, the fluxing gas can be introduced down a hollow shaft and out through radial holes in the impeller. The fluxing gas aids in floating impurities to the surface of the melt where it can be further treated to remove occluded aluminum.

The amount of flux used for aluminum is the amount sufficient to remove inclusions. The amount can range from 5 to 20 ounces of flux to about 800 lbs. of aluminum, with typical amounts being 8 to 14 oz. Fluxing temperatures can range from the melting point to 1450° to 1525° F. When using the flux composition in conjunction with a fluxing glass that is introduced through an impeller, it is preferred that the fluxing gas flow rate be reduced or stopped until the flux composition is ingested and thoroughly dispersed in the melt by the impeller. Typically, this can be accomplished in one or two minutes. Thereafter, the flow rate of fluxing gas can be increased to the desired rate.

While the invention has been described in terms of preferred embodiments, the claims appended hereto are intended to encompass other embodiments which fall within the spirit of the invention.

What is claimed is:

1. A flux suitable for use in removing inclusions from molten aluminum, the flux comprising:
32 to 61 wt. % sodium chloride;
2 to 15 wt. % magnesium chloride; and
2 to 12 wt. % carbon, the remainder potassium chloride.

2. The flux composition in accordance with claim 1 wherein carbon in the flux composition has a particle size in the range of −3 to +14 mesh.

3. The flux composition in accordance with claim 1 wherein sodium chloride in the flux composition is in the range of 43 to 50 wt. %.

4. The flux composition in accordance with claim 1 wherein potassium chloride in the flux composition is in the range of 32 to 61 wt. %.

5. The flux composition in accordance with claim 1 wherein magnesium chloride in the flux composition is in the range of 4 to 7 wt. %.

6. The flux composition in accordance with claim 1 wherein carbon in the flux composition has a particle size in the range of −16 to +20 mesh.

7. A flux suitable for use in removing inclusions from molten aluminum, the flux comprising:
43 to 50 wt. % sodium chloride;
4 to 7 wt. % magnesium chloride; and
3 to 8 wt. % carbon, the remainder potassium chloride, the carbon having a particle size in the range of −3 to +14 mesh.

8. In an improved process for recovering aluminum from dross in which aluminum dross is melted under a flux composition to separate aluminum values from the dross, the improvement wherein the flux composition consists essentially of:
32 to 61 wt. % sodium chloride;
2 to 15 wt. % magnesium chloride; and
2 to 12 wt. % carbon, the remainder potassium chloride.

9. The process in accordance with claim 8 wherein carbon in the flux composition has a particle size in the range of −3 to +14 mesh.

10. The process in accordance with claim 8 wherein sodium chloride in the flux composition is in the range of 32 to 61 wt. %.

11. The process in accordance with claim 8 wherein potassium chloride in the flux composition is in the range of 43 to 50 wt. %.

12. The process in accordance with claim 8 wherein magnesium chloride in the flux composition is in the range of 4 to 9 wt. %.

13. The process in accordance with claim 8 wherein carbon in the flux composition has a particle size in the range of −16 to +20 mesh.

14. The improved process for recovering aluminum from dross in which aluminum dross is melted under a flux composition to separate aluminum values from the dross, the improvement wherein the flux composition consists essentially of:
43 to 50 wt. % sodium chloride;
4 to 7 wt. % magnesium chloride; and
3 to 8 wt. % carbon, the remainder potassium chloride, the carbon having a particle size in the range of −3 to +14 mesh.

15. In an improved process for removing inclusions from molten aluminum in which a flux composition is introduced into the molten aluminum to separate inclusions from the molten aluminum, the improvement wherein the flux composition consists essentially of:
32 to 61 wt. % sodium chloride;
2 to 15 wt. % magnesium chloride; and
2 to 12 wt. % carbon, the remainder potassium chloride.

16. The process in accordance with claim 15 wherein carbon in the flux composition has a particle size in the range of −3 to +14 mesh.

17. The process in accordance with claim 15 wherein sodium chloride in the flux composition is in the range of 43 to 50 wt. %.

18. The process in accordance with claim 15 wherein potassium chloride in the flux composition is in the range of 32 to 61 wt. %.

19. The process in accordance with claim 15 wherein magnesium chloride in the flux composition is in the range of 4 to 7 wt. %.

20. The process in accordance with claim 15 wherein carbon in the flux composition has a particle size in the range of −3 to +24 mesh.

21. In an improved process for removing inclusions from molten aluminum in which a flux composition is introduced into the molten aluminum to separate inclusions from the molten aluminum, the improvement wherein the flux composition consists essentially of:
43 to 50 wt. % sodium chloride;
4 to 7 wt. % magnesium chloride; and
3 to 8 wt. % carbon, the remainder potassium chloride, the carbon having a particle size in the range of −3 to +14 mesh.

22. In an improved process for removing inclusions from molten aluminum in which a salt flux composition is introduced into the molten aluminum to separate inclusions from the molten aluminum, the improvement wherein a fluxing gas is introduced concurrently with the salt flux composition, the improvement further wherein the salt flux composition consists essentially of:
32 to 61 wt. % sodium chloride;
2 to 15 wt. % magnesium chloride; and
2 to 12 wt. % carbon, the remainder potassium chloride.

* * * * *